US011183052B2

(12) United States Patent
Awad Alla et al.

(10) Patent No.: US 11,183,052 B2
(45) Date of Patent: Nov. 23, 2021

(54) ENHANCED VEHICLE OPERATION

(71) Applicant: Ford Global Technologies, LLC, Dearborn, MI (US)

(72) Inventors: Michael Adel Awad Alla, Novi, MI (US); Ray Siciak, Ann Arbor, MI (US); David A. Symanow, Plymouth, MI (US); Tsung-Han Tsai, Ypsilanti, MI (US); Dhanunjay Vejalla, Novi, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 225 days.

(21) Appl. No.: 16/512,681

(22) Filed: Jul. 16, 2019

(65) Prior Publication Data

US 2021/0020037 A1 Jan. 21, 2021

(51) Int. Cl.

| | |
|---|---|
| ***G08G 1/01*** | (2006.01) |
| ***G08G 1/017*** | (2006.01) |
| ***G08G 1/16*** | (2006.01) |
| ***G08G 1/052*** | (2006.01) |

(52) U.S. Cl.

CPC ..... *G08G 1/0145* (2013.01); *G08G 1/017* (2013.01); *G08G 1/052* (2013.01); *G08G 1/164* (2013.01); *G08G 1/166* (2013.01); *G08G 1/167* (2013.01)

(58) Field of Classification Search

CPC .... G08G 1/0116; G08G 1/0145; G08G 1/017; G08G 1/04; G08G 1/052; G08G 1/164; G08G 1/166; G08G 1/167

See application file for complete search history.

(56) References Cited

U.S. PATENT DOCUMENTS

| | | | | |
|---|---|---|---|---|
| 5,952,941 | A * | 9/1999 | Mardirossian | G08G 1/01 340/936 |
| 7,333,012 | B1 * | 2/2008 | Nguyen | B60R 25/04 340/426.1 |
| 9,862,315 | B2 | 1/2018 | Hoye | |
| 2008/0167821 | A1 * | 7/2008 | Breed | G08G 1/161 701/301 |
| 2013/0201316 | A1 | 8/2013 | Binder et al. | |
| 2018/0357895 | A1 * | 12/2018 | Farajpour | H04W 84/18 |

FOREIGN PATENT DOCUMENTS

| | | |
|---|---|---|
| WO | 2016125111 A1 | 8/2016 |
| WO | 2019043446 A1 | 3/2019 |

OTHER PUBLICATIONS

"Definition of necessary vehicle and infastructure systems for Automated Driving", SMART—2010/0064, Version 1.2, Study Report.

* cited by examiner

*Primary Examiner* — Sisay Yacob
(74) *Attorney, Agent, or Firm* — Frank A. MacKenzie; Bejin Bieneman PLC

(57) ABSTRACT

A computer includes a processor and a memory, the memory storing instructions executable by the processor to collect steering, speed, and position data about a plurality of vehicles from one or more infrastructure sensors, identify a vehicle that varies from a specified position in a roadway lane relative to a roadway lane marker or exceeds a threshold speed based on the collected data, instruct the identified vehicle to move to a side of a roadway, and send a message to a central server including an identification of the vehicle.

20 Claims, 4 Drawing Sheets

ENHANCED VEHICLE OPERATION

BACKGROUND

Vehicles can collect data of their surroundings while operating. Based on the data, computers in the vehicles can identify nearby objects. For example, the computers can detect other vehicles traveling on the roadway. The computers can transmit the data to a central server. The transmissions occur over a network. Such networks typically have dedicated bandwidth for transmissions.

DETAILED DESCRIPTION

Figure 1:
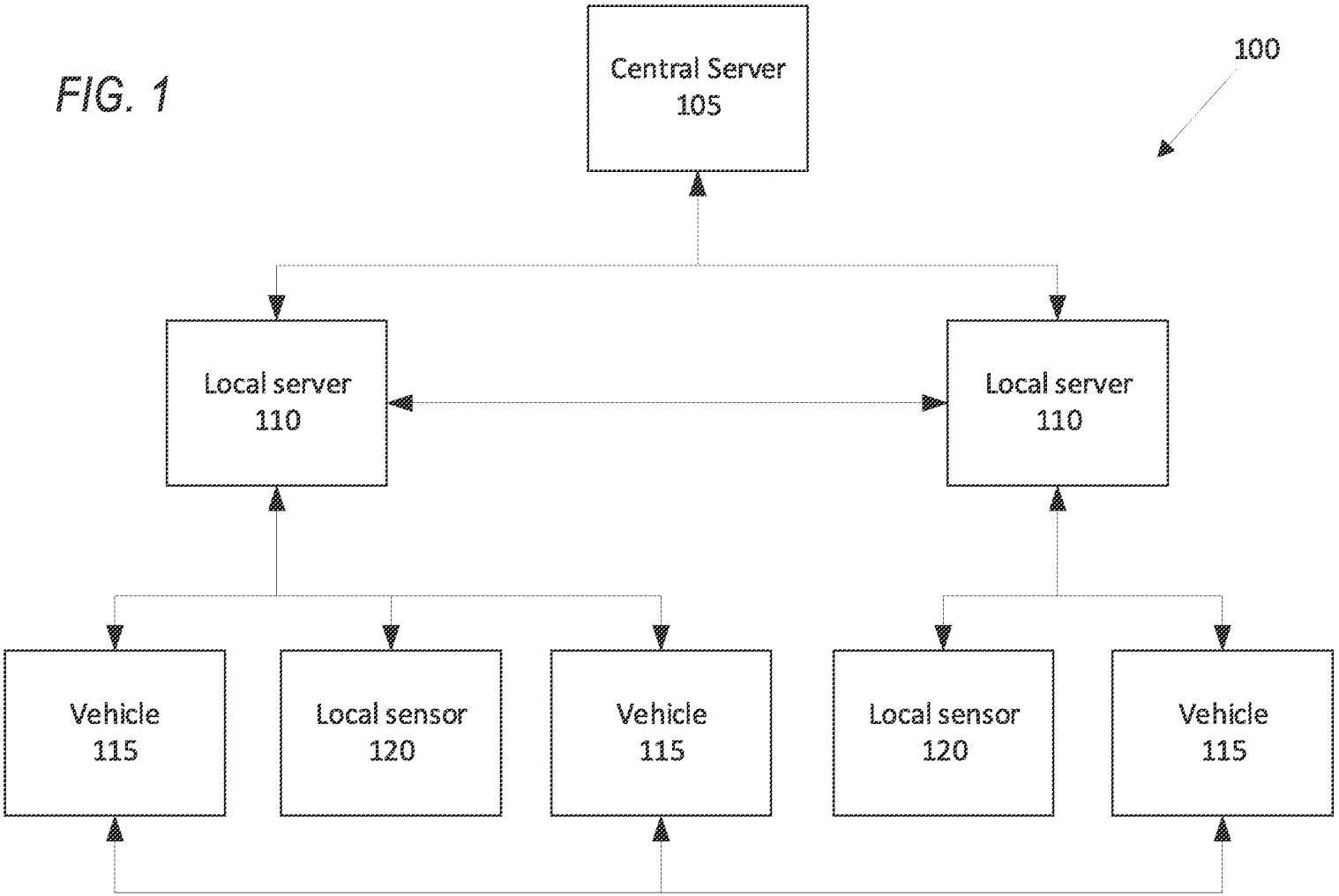
FIG. 1 is a diagram of an example system for detecting erratically moving vehicles.

A computer includes a processor and a memory, the memory storing instructions executable by the processor to collect steering, speed, and position data about a plurality of vehicles from one or more infrastructure sensors, identify a vehicle that varies from a specified position in a roadway lane relative to a roadway lane marker or exceeds a threshold speed based on the collected data, instruct the identified vehicle to move to a side of a roadway, and send a message to a central server including an identification of the vehicle.

The instructions can further include instructions to identify the vehicle when the speed of one of the plurality of vehicles exceeds a posted speed limit.

The instructions can further include instructions to identify the vehicle when one of the plurality of vehicles moves toward a first roadway lane marking and then moves toward a second roadway lane marking laterally disposed from the first roadway lane marking.

The instructions can further include instructions to identify the vehicle when one of the plurality of vehicles moves into a portion of a roadway where vehicles are not permitted to operate.

The instructions can further include instructions to collect data about the plurality of vehicles from one or more of the plurality of vehicles.

The instructions can further include instructions to instruct the vehicle to power off.

The instructions can further include instructions to input the collected data to a machine learning program to provide an output identifying the vehicle.

The machine learning program can be trained with previously collected vehicle data.

The computer can be disposed at an intersection and the instructions can further include instructions to collect data about the plurality of vehicles from a second computer disposed at a second intersection.

The intersection can include at least one roadway sign or roadway light, at least one of the infrastructure sensors is disposed on the roadway sign or the roadway light, and the instructions can further include instructions to collect data from the at least one infrastructure sensor disposed on the roadway sign or the roadway light at the intersection.

The instructions can further include instructions to receive an identification of the vehicle from one of the plurality of vehicles.

The infrastructure sensors can be disposed on at least one of a roadway sign or a roadway light.

A method includes collecting steering, speed, and position data about a plurality of vehicles from one or more infrastructure sensors, identifying a vehicle that varies from a specified position in a roadway lane relative to a roadway lane marker or exceeds a threshold speed based on the collected data, instructing the identified vehicle to move to a side of a roadway, and sending a message to a central server including an identification of the vehicle.

The method can further include identifying the vehicle when the speed of one of the plurality of vehicles exceeds a posted speed limit.

The method can further include identifying the vehicle when one of the plurality of vehicles moves toward a first roadway lane marking and then moves toward a second roadway lane marking laterally disposed from the first roadway lane marking.

The method can further include identifying the vehicle when one of the plurality of vehicles moves into a portion of a roadway where vehicles are not permitted to operate.

The method can further include collecting data about the plurality of vehicles from one or more of the plurality of vehicles.

The method can further include instructing the vehicle to power off.

The method can further include inputting the collected data to a machine learning program to provide an output identifying the vehicle.

The method can further include collecting data about the plurality of vehicles from a computer disposed at an intersection.

The intersection can include at least one roadway sign or roadway light, at least one of the infrastructure sensors is disposed on the roadway sign or the roadway light, and the method can further include collecting data from the at least one infrastructure sensor disposed on the roadway sign or the roadway light at the intersection.

The method can further include receiving an identification of the vehicle from one of the plurality of vehicles.

A system includes a central server, one or more infrastructure sensors, a plurality of vehicles, a local server in communication with the central server, the infrastructure sensors, and the plurality of vehicles, means for collecting steering, speed, and position data about the plurality of vehicles from the infrastructure sensors, means for identifying a vehicle that varies from a specified position in a roadway lane relative to a roadway lane marker or exceeds a threshold speed based on the collected data, means for instructing the identified vehicle to move to a side of a roadway, and means for sending a message to the central server including an identification of the vehicle.

The system can further include means for identifying the vehicle when the speed of one of the plurality of vehicles exceeds a posted speed limit.

The system can further include means for identifying the vehicle when one of the plurality of vehicles moves toward a first roadway lane marking and then moves toward a second roadway lane marking laterally disposed from the first roadway lane marking.

The system can further include means for identifying the vehicle when one of the plurality of vehicles moves into a portion of a roadway where vehicles are not permitted to operate.

Further disclosed is a computing device programmed to execute any of the above method steps. Yet further disclosed is a vehicle comprising the computing device. Yet further disclosed is a computer program product, comprising a computer readable medium storing instructions executable by a computer processor, to execute any of the above method steps.

A multilevel cloud computing system that includes a central server, a plurality of local servers, and a plurality of vehicles provides distributed computation of data, allowing each level of the multilevel cloud computing system to improve data collection and processing. Using autonomous vehicles to detect erratic behavior of other erratic vehicles allows the central server to perform fleetwide actions while the local servers focus on localized actions. The local sensors can collect data with sensors mounted to infrastructure to identify erratically moving vehicles. The local servers can send messages to the central server identifying the erratically moving vehicles, allowing the central server to address the erratically moving vehicles on a fleetwide scale while the local servers and the vehicles perform additional computations to identify the erratically moving vehicles.

FIG. 1 is a diagram of an example system 100 for detecting erratically moving vehicles. The system 100 includes a central server 105. The central server 105 is a remote site that stores and transmits data. The central server 105 includes a processor and a memory, e.g., a data store. The central server 105 can include programming for managing a fleet of vehicles, as described below.

The system 100 includes one or more local servers 110. The central server 105 can communicate with the local servers 110. Each local server 110 includes a respective processor and memory. In this context, "local" means that the local servers 110 are disposed at specified locations from or at which the local server does not move (absent being uninstalled or the like), and that the local servers 110 each collect data from a predetermined area around the respective local server 110, e.g., 400 square meters. For example, each local server 110 can be located at an intersection of two or more roadways. The local servers 110 can be located such that all locations in a specific geographic area (e.g., a city, a municipal county, etc.) can be detected by at least one local server 110. Each local server 110 can communicate with other local servers 110 to exchange data, e.g., data about one or more vehicles 115 as described below.

The local servers 110 communicate with one or more vehicles 115. Each vehicle 115 includes a computer including a processor and a memory. The computer is programmed to receive collected data from one or more sensors, e.g., vehicle 115 sensors, concerning various metrics related to the vehicle 115. For example, the metrics may include a velocity of the vehicle 115, vehicle 115 acceleration and/or deceleration, data related to vehicle 115 path or steering, biometric data related to a vehicle 115 operator, e.g., heart rate, respiration, pupil dilation, body temperature, state of consciousness, etc. Further examples of such metrics may include measurements of vehicle systems and components (e.g. a steering system, a powertrain system, a brake system, internal sensing, external sensing, etc.).

The computer is generally programmed for communications on a controller area network (CAN) bus or the like. The computer may also have a connection to an onboard diagnostics connector (OBD-II). Via the CAN bus, OBD-II, and/or other wired or wireless mechanisms, the computer may transmit messages to various devices in a vehicle and/or receive messages from the various devices, e.g., controllers, actuators, sensors, etc., including sensors. Alternatively or additionally, in cases where the computer actually comprises multiple devices, the CAN bus or the like may be used for communications between devices represented as the computer in this disclosure. In addition, the computer may be programmed for communicating with the network, which may include various wired and/or wireless networking technologies, e.g., cellular, Bluetooth, wired and/or wireless packet networks, etc. The computer may communicate with the local servers 110 over the network.

Collected data may include a variety of data collected in a vehicle 115. Examples of collected data are provided above, and moreover, data is generally collected using one or more sensors, and may additionally include data calculated therefrom in the computer, and/or at the local server 110 and/or the central server 105. In general, collected data may include any data that may be gathered by the sensors and/or computed from such data.

When the computer partially or fully operates the vehicle 115, the vehicle 115 is an "autonomous" vehicle 115. For purposes of this disclosure, the term "autonomous vehicle" is used to refer to a vehicle 115 operating in a fully autonomous mode. A fully autonomous mode is defined as one in which each of vehicle propulsion, braking, and steering are controlled by the computer. A semi-autonomous mode is one in which at least one of vehicle propulsion, braking, and steering are controlled at least partly by the computer as opposed to a human operator. In a non-autonomous mode, i.e., a manual mode, the vehicle propulsion, braking, and steering are controlled by the human operator.

The system 100 includes one or more sensors 120. Sensors 120 can include a variety of devices, including cameras, motion detectors, etc., i.e., sensors 120 to provide data for evaluating a position of a vehicle 115, evaluating a speed of a vehicle 115, etc. The sensors 120 could, without limitation, also include short range radar, long range radar, lidar, and/or ultrasonic transducers. The sensors 120 can be mounted to infrastructure, e.g., a roadway sign, a roadway light such as a traffic light, a light pole, etc., at an intersection. The sensors 120 can collect data about one or more vehicles 115 and transmit the data to the local server 110. That is, each local server 110 can communicate with one or more sensors 120 within a specific area (e.g., 400 square meters) to collect data about one or more vehicles 115. The sensors 120 within the specific area can be "local" sensors 120.

The central server 105, the local servers 110, the vehicles 115, and the sensors 120 communicate over a network (not shown). The network represents one or more mechanisms by which a vehicle 115 computer may communicate with the local server 110 and the local server 110 can communicate with the central server 105. Accordingly, the network can be one or more of various wired or wireless communication mechanisms, including any desired combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary communication networks include wireless communication networks (e.g., using Bluetooth®, Bluetooth® Low Energy (BLE), IEEE 802.11, a vehicle-to-everything network (V2X), where "X" signifies an entity with which a vehicle can communicate, e.g., vehicle-to-vehicle (V2V) such as Dedicated Short Range Communications (DSRC), etc.), vehicle-to-infrastructure (V2I), vehicle-to-network (V2N), vehicle-to-device (V2D), vehicle-to-grid (V2G), vehicle-to-pedestrian (V2P) such as a cellular-V2X (C-V2X) network, etc., local area networks (LAN) and/or wide area networks (WAN), including the Internet, providing data communication services.

The central server 105, the local servers 110, and the vehicles 115 are respective layers of a multilayer cloud computing system. In this context, a "multilayer cloud computing system" is a plurality of computers (e.g., servers, vehicle computers, etc.) communicating over a network, where each computer belongs to a "layer." A "layer" is a set of computers that provides a certain kind of data and/or calculation and/or determination to other layers. Each layer includes one or more devices that collect and transmit data. That is, each device in each layer of the multilayer cloud computing system can perform specific actions and collect specific data that is transmitted to devices of the other layers. Computers in each layer transmit and receive data from computers in the other layers. In the example of FIG. 1, the multilayer cloud computing system includes a "cloud" layer including the central server 105, a "fog" layer including the local servers 110, and an "edge" layer including the vehicles 115. The edge layer collects and processes granular data and selects relevant data to send to the fog layer. The fog layer aggregates the selected data from the edge layer, processes the data, and selects data to send to the cloud layer, regulating data between the edge layer and the cloud layer. The cloud layer collects and processes the selected data from the fog layer to provide instructions to the fog layer and to the edge layer. By distributing the computing among multiple layers, the multilayer cloud computing system can process data closer in time to collection of the data, improving data collection and processing for operation of the vehicles 115 to identify erratically moving vehicles 115 and mitigate potential collisions. That is, the central server 105 can focus on fleetwide operations, e.g., monitoring a plurality of vehicles 115, and the local servers 110 can identify erratically moving vehicles 115 without input from the central server 105, reducing the computations required by the central server 105. The fog and edge layers allow for processing of the data decentralized from the cloud layer, allowing the cloud layer to receive and manage processed data.

As described above, the central server 105 can be a "cloud layer," i.e., a remote site that includes one or more computers and/or servers that collect and process data for management of a plurality of vehicles 115 over a large geographic area and stores data. The local servers 110 can be a "fog layer," i.e., a localized computer focused on smaller geographic areas and fewer vehicles 115. The local servers 110 can collect and process data that the central server 105 may not have capacity to process, e.g., predicting trajectories of vehicles 115. The vehicles 115 can be an "edge layer" of the multilayer cloud computing system, i.e., individual vehicles 115 that include computers to collect and process real-time data for one or more nearby vehicles 115. The vehicles 115 can process data that the local servers 110 may not have capacity to process, e.g., detecting and recording a speed of another vehicle 115.

Figure 2:
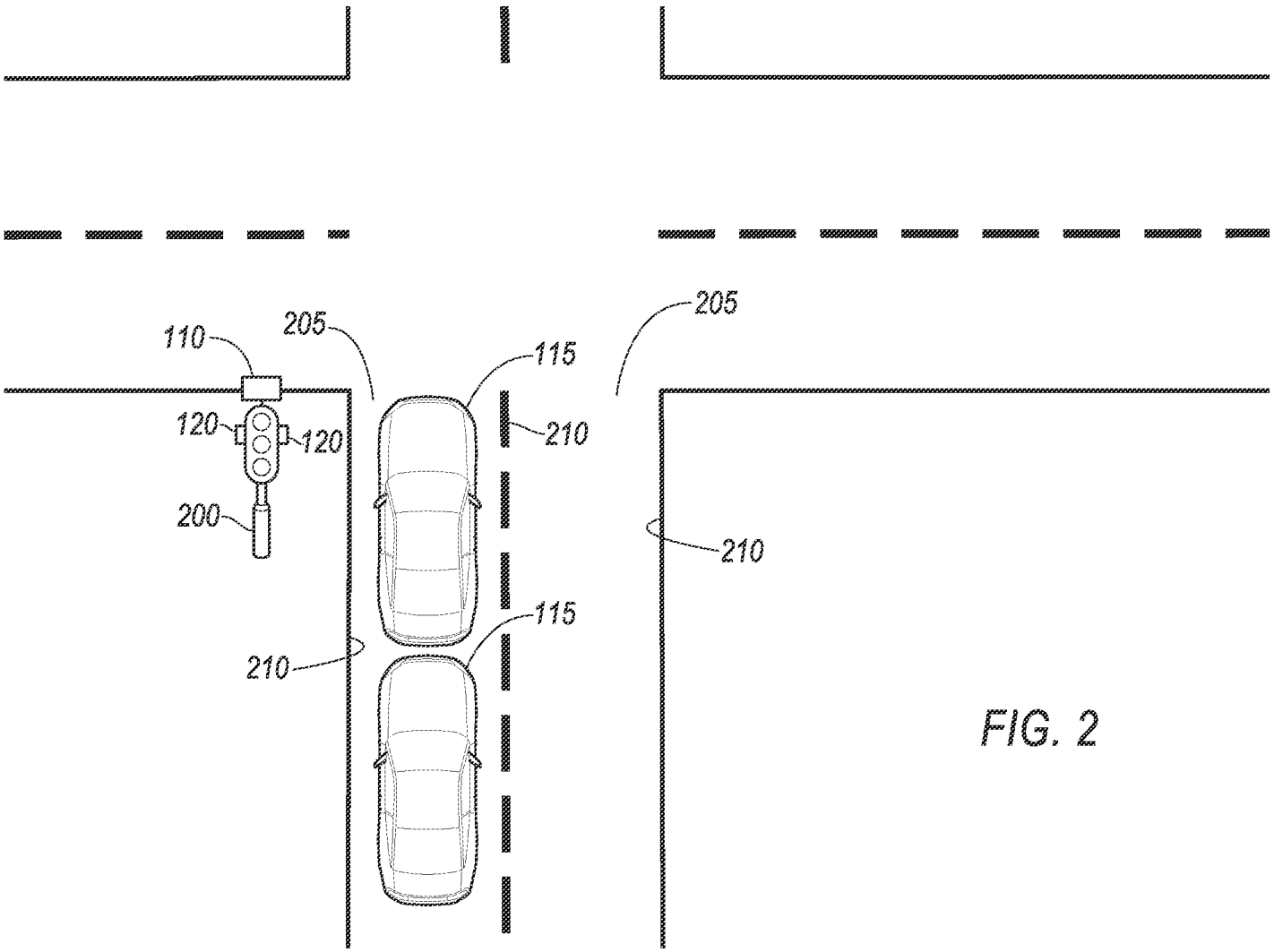
FIG. 2 is a plan view of a local server at an intersection detecting vehicles.
Figure 3:
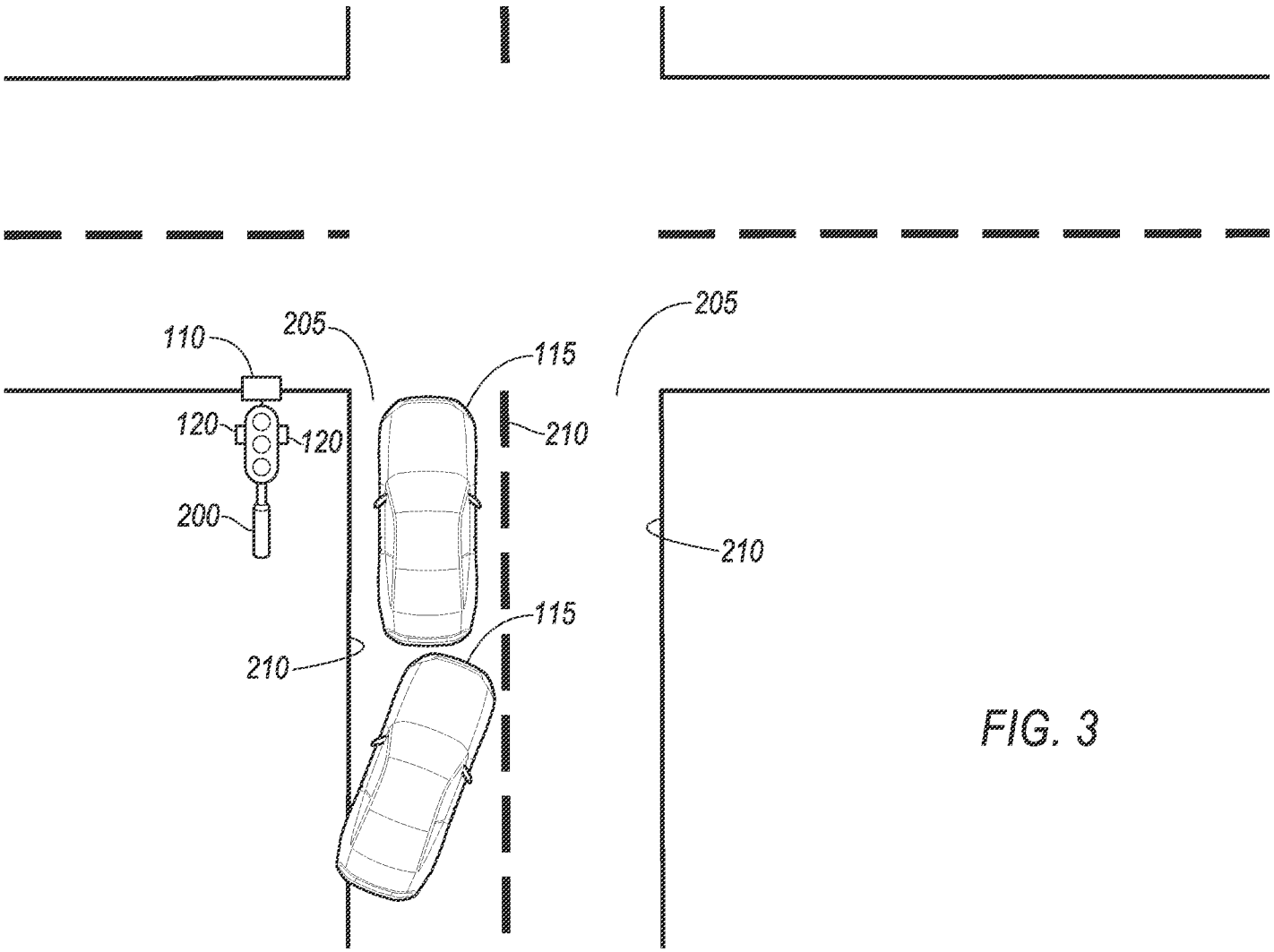
FIG. 3 is a plan view of an intersection with an erratically moving vehicle.

FIG. 2 is a plan view of a local server 110 and a plurality of vehicles 115 at an intersection, i.e., a location where two or more roadways intersect. The local server 110 can be disposed on infrastructure, e.g., a traffic light 200. The local server 110 can instruct one or more sensors 120 to collect data about the vehicles 115. For example, the sensors 120 can collect steering, speed, and position data for each vehicle 115, e.g., according to one or more various known techniques, e.g., by collecting images from cameras to determine positions of the vehicles 115 in a roadway, collecting radar data to determine speeds of the vehicles 115, collecting lidar data to generate point clouds showing surfaces of the vehicles 115 over time to predict steering paths of the vehicles 115, etc. In another example, the sensors 120 can collect image data of the vehicles 115 and roadway lane markings 210, as described below, to determine positions of the vehicles 115 relative to the roadway lane markings 210 and whether the vehicles 115 are crossing over the roadway lane markings 210. Each vehicle 115 can collect data about other nearby vehicles 115 and transmit the data to the local server 110 over the network. For example, each vehicle 115 can collect speed data of each other vehicle 115.

The local server 110 identifies an erratically moving vehicle 115. In this context, a vehicle moves "erratically" when movement of a vehicle 115 exceeds one of a plurality of predetermined standards for vehicle 115 operation. That is, "erratic" movement, or a vehicle behaving "erratically," is movement of a subject vehicle 115 exceeding one or more thresholds specified for conventional (i.e., non-erratic) operation of a plurality of vehicles 115. For example, the local server 110 can determine that a vehicle 115 is moving erratically when a speed of the vehicle 115 exceeds a speed threshold, e.g., a posted speed limit, an average speed of one or more vehicles 115 detected by the local server 110, etc.

In another example, the local server 110 can determine that a vehicle 115 is moving erratically based on a position of the vehicle 115 in a roadway lane 205 relative to roadway lane marking 210. As described above, the local server 110 can instruct one or more sensors 120 to collect data (e.g., image data, radar data, lidar data, etc.) of the vehicle 115, the roadway lane 205, and the roadway lane markings 210. The local server 110 can use a conventional image-recognition technique, e.g., Canny edge detection, gradient matching, scale-invariant feature transforms, etc., to identify the vehicle 115, the roadway lane 205, and the roadway lane markings 210. The local server 110 can determine the position of the vehicle 115 in the roadway lane 205 relative to the roadway lane markings 210 with a conventional distance determining technique, e.g., blur detection, a reference such as a known length of one of the roadway lane markings 210, etc. If a vehicle 115 is swerving in the roadway lane 205, the local server 110 and/or another vehicle 115 can determine that the vehicle 115 is moving erratically. In this context, the vehicle is "swerving" when the vehicle 115 moves toward a first roadway lane marking 210 and then moves toward a second roadway lane marking 210 laterally disposed from the first roadway lane marking 210 in an elapsed time that is below a time threshold. The time threshold can be a time to move from the first roadway lane marking 210 to the second roadway lane marking 210 at a speed beyond which the vehicle 115 will cross the second roadway lane marking 210 when the steering component 120 steers the vehicle 115 away from the second roadway lane marking 210. The speed can be determined based on empirical testing and/or simulation testing of vehicles 115 moving toward roadway lane markings 210 at specific speeds and attempting to steer away from the roadway lane markings 210. That is, each roadway lane 205 is defined by two sets of roadway lane markings 210, and when the vehicle 115 quickly moves between the roadway lane markings, the vehicle 115 "swerves."

In another example, the local server 110 can determine that a vehicle 115 is moving erratically when a steering angle of the vehicle 115 exceeds a steering angle threshold. The steering angle threshold can be a steering angle at which the vehicle 115 would leave the current roadway lane 205 in a time threshold (e.g., 3 seconds). That is, the steering angle threshold can be determined as a steering angle that would typically cause the vehicle 115 to leave the current roadway lane 205, e.g., as determined based on empirical testing of vehicles 115 of specific steering angles between roadway lane markings 210. The local server 110 can detect the steering angle of the vehicles 115 with the sensors 120. For example, the local server 110 can instruct the sensors 120 to collect image data of the vehicles 115 over a period of time, e.g., 500 milliseconds (ms) in 50 ms increments, and can identify changes in positions of the vehicles 115 during the period of time with an image recognition technique as described above, Based on changes in the positions of the vehicles 115 in a vehicle-crosswise direction (i.e., transverse to forward motion of the vehicles 115), the local server 110 can detect the change in steering angles of the vehicles 115. Alternatively or additionally, steering angle sensors in the vehicles 115 can determine steering angles of the vehicles 115 and transmit the steering angle data over the network to the local server 110.

In another example, the local server 110 can determine that a vehicle 115 is moving erratically when a position of the vehicle 115 is on a portion of a roadway where vehicles 115 are not permitted to operate. That is, portions of roadways can be designated as impermissible to travel, e.g., portions under construction, portions of a shoulder, portions past a stop sign without previously stopping, portions past a stoplight during a red light, etc. That is, the portions of the roadway can be designated as impermissible for travel based on local traffic regulations. The local server 110 can identify the position of the vehicle 115 based on, e.g., image data from one or more sensors 120 as described above. The local server 110 can compare the identified position of the vehicle 115 to stored locations that are identified as unpermitted for vehicle 115 operation. The local server 110 can receive the locations identified as unpermitted from the central server 105. When the local server 110 identifies the location of the vehicle 115 as a portion of the roadway where vehicles 115 are not permitted to operate, the local server 110 can identify the vehicle 115 as an erratically moving vehicle 115. In another example, if the position data of the vehicle 115 indicate that the vehicle 115 is partly disposed in two roadway lanes (i.e., the vehicle 115 is moving over a roadway lane marking 210 but not changing roadway lanes 205), the local server 110 can identify the vehicle 115 as an erratically moving vehicle 115.

The local server 110 can determine the threshold(s) for erratic behavior such as described above based on data collected from the vehicles 115 and/or one or more sensors 120. The data can include speed data, location data, movement data, etc. The local server 110 can input the data into a machine learning program to identify thresholds such as the speed threshold and the time threshold described above. The machine learning program can be, e.g. a convolutional neural network. The machine learning program can be trained by inputting steering, speed, and position data from reference vehicles 115 that are not identified as moving erratically and adjusting coefficients of a cost function using, e.g., gradient descent, to output that the reference vehicles 115 are not moving erratically. With the steering, speed, and position data, the machine learning program can be trained to identify respective ranges for steering angle, speed, and position of the vehicles 115 and an average steering angle, speed, and position. The machine learning program can output the ranges for the steering angle, speed, and position that the local servers 110 can use as respective thresholds for the steering angle, speed, and position. For example, if input speed data indicate that a speed range of the vehicles is 40-50 miles per hour (mph), the machine learning program can output the average speed as 45 mph and the speed range as 5 mph. Then, upon detecting a speed of a vehicle 115 that is outside the speed range from the average speed, e.g., less than 40 mph or more than 50 mph, the local server 110 can identify the vehicle 115 as an erratically moving vehicle 115. In another example, input steering data to the machine learning program can result in an output that a steering angle range is −5°-5° and an average steering angle of 0°. The local server 110 can use these outputs as respective thresholds for determining whether a vehicle 115 is moving erratically.

Upon identifying an erratically moving vehicle 115, the local server 110 can instruct the erratically moving vehicle 115 to move out of a current roadway lane 205 to a side of the roadway. A "side" of the roadway is a portion of the roadway designated for vehicles 115 to stop, e.g., a shoulder. The local server 110 can store a set of geo-coordinate data that are locations of sides of roadways, and the local server 110 can instruct the erratically moving vehicle 115 to move to specific geo-coordinates of the side of the roadway. By instructing the erratically moving vehicle 115 to move to the side of the roadway, the local server 110 removes the erratically moving vehicle 115 from the roadway lane 205 and from other vehicles 115, reducing the likelihood of the erratically moving vehicle 115 colliding with another vehicle 115.

Upon instructing the erratically moving vehicle 115 to move to the side of the roadway, the local server 110 can send a message to the central server 105 identifying the erratically moving vehicle 115. The message can include a location of the erratically moving vehicle 115 and/or an indication of the criteria that the local server 110 used to identify the erratically moving vehicle 115. For example, the message can include the speed of the erratically moving vehicle 115 that exceeded the speed threshold.

Upon receiving the message indicating the erratically moving vehicle 115, the central server 105 can instruct the vehicle 115 to mitigate the erratic movement. For example, the central server 105 can instruct the vehicle 115 to move to a repair location to repair one or more components that may be fault and may have caused the erratic movement. In another example, the central server 105 can instruct the vehicle 115 to receive data from another vehicle 115 and/or the local server 110 and to use the data to operate one or more components. The central server 105 can instruct the erratically moving vehicle 115 to use data from the local server 110 and/or other vehicles 115 that may be more reliable than data collected by the erratically moving vehicle 115. That is, the erratically moving vehicle 115 may have one or more sensors that are faulty, i.e., damaged and/or incorrectly collecting data, and using data from the local server 110 and/or the other vehicles 115 may mitigate the erratic movement of the erratically moving vehicle 115. In yet another example, the central server 105 can send a human operator to the erratically moving vehicle 115 to diagnose one or more faults that caused the erratic movement and to operate the vehicle 115 in a manual mode to a repair location.

Figure 4:
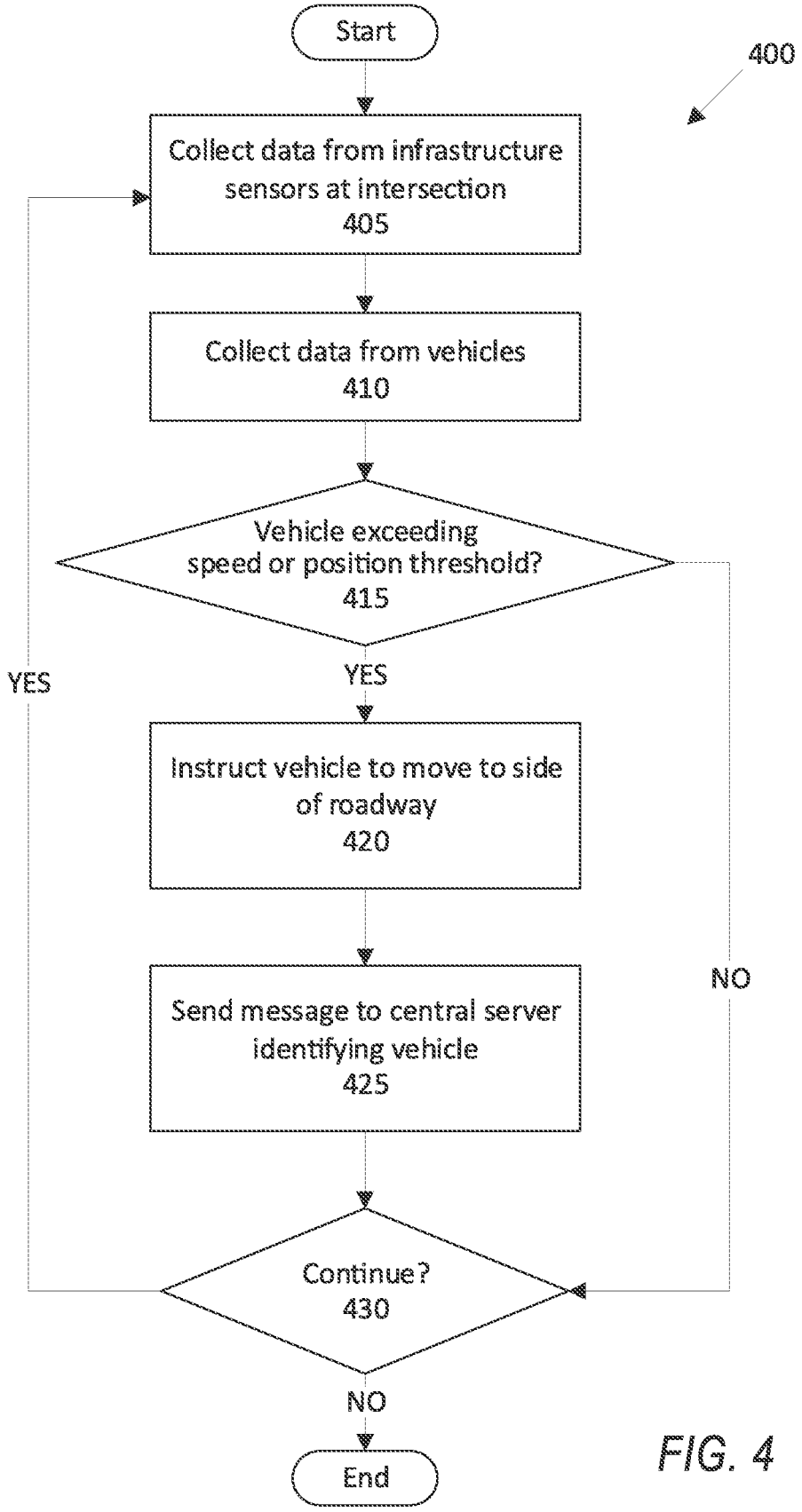
FIG. 4 is an example process for detecting erratically moving vehicles.

FIG. 4 is a diagram of an example process 400 for detecting erratically moving vehicles 115. The process 400 begins in a block 405, in which a local server 110 collects data about a plurality of vehicles 115. The local sever 110 can collect the data from one or more sensors 120 mounted to infrastructure at an intersection. For example, the local server 110 can collect data from a plurality of cameras 120 mounted to a traffic light 200.

Next, in a block 410, the local server 110 collects data from a plurality of vehicles 115 about other vehicles 115 at the intersection. Each vehicle 115 can collect data such as image data, speed data, steering data, etc., about other vehicles 115 and can transmit the data to the local server 110. That is, each vehicle 115 includes a plurality of sensors that collect data, and each vehicle 115 can transmit the data to the local server 110.

Next, in a block 415, the local server 110 determines whether data about one of the plurality of vehicles 115 indicate that the vehicle 115 exceeds a speed threshold or a position threshold. As described above, when a speed of the vehicle 115 exceeds a speed threshold or a position of the vehicle 115 indicates that the vehicle 115 swerves or is on a portion of a roadway unpermitted for vehicles 115, the local server 110 can determine that the vehicle 115 is behaving erratically. As described above, the speed threshold and the position threshold can be determined based on, e.g., posted speed limits, average speed and position data of other vehicles 115, location map data indicating unpermitted areas for vehicles 115, etc. If the local server 110 determines that the data indicate that one of the vehicles 115 exceeds the speed threshold or the position threshold, the process 400 continues in a block 420. Otherwise, the process 400 continues in a block 430.

In the block 420, the local server 110 instructs the erratically moving vehicle 115 to move to a side of the roadway. As described above, when the erratically moving vehicle 115 moves to the side of the roadway and stops, the vehicle 115 is away from other vehicles 115 in the roadway, reducing a likelihood of a collision between the erratically moving vehicle 115 and other vehicles 115.

Next, in a block 425, the local server 110 sends a message to the central server 105 identifying the erratically moving vehicle 115. As described above, the message can include a location of the vehicle 115, the data that indicated to the local server 110 that the vehicle 115 was moving erratically, etc. The central server 105 can instruct the vehicle 115 to perform countermeasures to address the erratic movement, e.g., the central server 105 can instruct the vehicle 115 to move to a repair location to repair one or more components that could have cause the erratic movement of the vehicle 115.

In the block 430, the local server 110 determines whether to continue the process 400. For example, the local server 110 can determine to continue the process 400 upon detecting additional vehicles 115 at the intersection. If the local server 110 determines to continue, the process 400 returns to the block 405 to collect additional data. Otherwise, the process 400 ends.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, data collector measurements, computations, processing time, communications time, etc.

Computing devices discussed herein, including the central server 105 and the local server 110 include processors and memories, the memories generally each including instructions executable by one or more computing devices such as those identified above, and for carrying out blocks or steps of processes described above. Computer executable instructions may be compiled or interpreted from computer programs created using a variety of programming languages and/or technologies, including, without limitation, and either alone or in combination, Java™, C, C++, Python, Visual Basic, Java Script, Perl, HTML, etc. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in the local server 110 is generally a collection of data stored on a computer readable medium, such as a storage medium, a random access memory, etc.

A computer readable medium includes any medium that participates in providing data (e.g., instructions), which may be read by a computer. Such a medium may take many forms, including, but not limited to, non volatile media, volatile media, etc. Non volatile media include, for example, optical or magnetic disks and other persistent memory. Volatile media include dynamic random access memory (DRAM), which typically constitutes a main memory. Common forms of computer readable media include, for example, a floppy disk, a flexible disk, hard disk, magnetic tape, any other magnetic medium, a CD ROM, DVD, any other optical medium, punch cards, paper tape, any other physical medium with patterns of holes, a RAM, a PROM, an EPROM, a FLASH EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. For example, in the process 400, one or more of the steps could be omitted, or the steps could be executed in a different order than shown in FIG. 4. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The article "a" modifying a noun should be understood as meaning one or more unless stated otherwise, or context requires otherwise. The phrase "based on" encompasses being partly or entirely based on.

What is claimed is:

1. A system, comprising a computer including a processor and a memory, the memory storing instructions executable by the processor to:

collect steering, speed, and position data about a plurality of vehicles from one or more infrastructure sensors;

identify a vehicle that varies from a specified position in a roadway lane relative to a roadway lane marker or exceeds a threshold speed based on the collected data;

instruct the identified vehicle to move to a side of a roadway; and send a message to a central server including an identification of the vehicle;

wherein the computer is disposed at an intersection and the instructions further include instructions to collect data about the plurality of vehicles from a second computer disposed at a second intersection.

2. The system of claim 1, wherein the instructions further include instructions to identify the vehicle when the speed of one of the plurality of vehicles exceeds a posted speed limit.

3. The system of claim 1, wherein the instructions further include instructions to identify the vehicle when one of the plurality of vehicles moves toward a first roadway lane marking and then moves toward a second roadway lane marking laterally disposed from the first roadway lane marking.

4. The system of claim 1, wherein the instructions further include instructions to identify the vehicle when one of the plurality of vehicles moves into a portion of a roadway where vehicles are not permitted to operate.

5. The system of claim 1, wherein the instructions further include instructions to collect data about the plurality of vehicles from one or more of the plurality of vehicles.

6. The system of claim 1, wherein the instructions further include instructions to instruct the vehicle to power off.

7. The system of claim 1, wherein the instructions further include instructions to input the collected data to a machine learning program to provide an output identifying the vehicle.

8. The system of claim 7, wherein the machine learning program is trained with previously collected vehicle data.

9. The system of claim 1, wherein the intersection includes at least one roadway sign or roadway light, at least one of the infrastructure sensors is disposed on the roadway sign or the roadway light, and the instructions further include instructions to collect data from the at least one infrastructure sensor disposed on the roadway sign or the roadway light at the intersection.

10. The system of claim 1, wherein the instructions further include instructions to receive an identification of the vehicle from one of the plurality of vehicles.

11. The system of claim 1, wherein the infrastructure sensors are disposed on at least one of a roadway sign or a roadway light.

12. A method, comprising:

collecting steering, speed, and position data about a plurality of vehicles from one or more infrastructure sensors at an intersection;

identifying a vehicle that varies from a specified position in a roadway lane relative to a roadway lane marker or exceeds a threshold speed based on the collected data;

instructing the identified vehicle to move to a side of a roadway; and sending a message to a central server including an identification of the vehicle; and collecting data about the plurality of vehicles from a second intersection.

13. The method of claim 12, further comprising identifying the vehicle when the speed of one of the plurality of vehicles exceeds a posted speed limit.

14. The method of claim 12, further comprising identifying the vehicle when one of the plurality of vehicles moves toward a first roadway lane marking and then moves toward a second roadway lane marking laterally disposed from the first roadway lane marking.

15. The method of claim 12, further comprising identifying the vehicle when one of the plurality of vehicles moves into a portion of a roadway where vehicles are not permitted to operate.

16. A system, comprising a computer including a processor and a memory, the memory storing instructions executable by the processor to:

collect steering, speed, and position data about a plurality of vehicles from one or more infrastructure sensors;

input the collected data to a machine learning program to provide an output identifying a vehicle that varies from a specified position in a roadway lane relative to a roadway lane marker or exceeds a threshold speed;

instruct the identified vehicle to move to a side of a roadway; and send a message to a central server including an identification of the vehicle.

17. The system of claim 16, wherein the instructions further include instructions to collect data about the plurality of vehicles from one or more of the plurality of vehicles.

18. The system of claim 16, wherein the instructions further include instructions to instruct the vehicle to power off.

19. The system of claim 16, wherein the machine learning program is trained with previously collected vehicle data.

20. The system of claim 16, wherein the infrastructure sensors are disposed on at least one of a roadway sign or a roadway light.

* * * * *